US011111693B1

(12) United States Patent
Luk et al.

(10) Patent No.: US 11,111,693 B1
(45) Date of Patent: Sep. 7, 2021

(54) SYSTEMS, APPARATUSES, AND METHODS FOR KNOCKDOWN LIVESTOCK FENCING

(71) Applicant: Rankam (China) Manufacturing Co. Ltd., Hong Kong (CN)

(72) Inventors: Mike Man Shun Luk, Hong Kong (CN); Andy Ning Fan Kam, Hong Kong (CN)

(73) Assignee: Rankam (China) Manufacturing Co. Ltd., Hong Kong (HK)

( * ) Notice: Subject to any disclaimer, the term of this patent is extended or adjusted under 35 U.S.C. 154(b) by 266 days.

(21) Appl. No.: 16/567,815

(22) Filed: Sep. 11, 2019

Related U.S. Application Data

(60) Provisional application No. 62/731,380, filed on Sep. 14, 2018.

(51) Int. Cl.
*E04H 17/14* (2006.01)

(52) U.S. Cl.
CPC ..... *E04H 17/1417* (2013.01); *E04H 17/1447* (2021.01); *E04H 17/1465* (2021.01)

(58) Field of Classification Search
CPC ..... E04H 17/1413; E04H 17/1447; E04H 17/1465; E04H 17/161; E04H 17/163; E04H 17/18; F16B 7/0406; F16B 7/182; A01K 3/002
See application file for complete search history.

(56) References Cited

U.S. PATENT DOCUMENTS 343,371 A 6/1886 Higgins
361,880 A 4/1887 Landis
799,595 A * 9/1905 Drewke ..... E04H 17/1413 256/68
2,150,651 A * 3/1939 Ewing ..... E04F 11/1817 403/201
3,522,960 A 8/1970 Moore
4,053,140 A * 10/1977 Clemens ..... F16B 7/0486 256/19

(Continued)

FOREIGN PATENT DOCUMENTS

GB 127429 A 6/1919

OTHER PUBLICATIONS

Co-Pending U.S. Appl. No. 16/567,831 (not prior art).

*Primary Examiner* — Jonathan P Masinick
(74) *Attorney, Agent, or Firm* — Lucian Wayne Beavers; Patterson Intellectual Property Law, PC

(57) ABSTRACT

A knockdown fence assembly and methods thereof are provided. The knockdown fence assembly comprises a first connector piece, a first plurality of horizontal connectors, a second plurality of horizontal connectors, and a plurality of connector fasteners. The first connector piece includes a vertical main connector body with first and second pluralities of horizontal connector support pieces extending from the vertical main body in opposite directions. The first plurality of horizontal connectors are coupled to the first plurality of horizontal connector support pieces and extend into the vertical main connector body. The second plurality of horizontal connectors also extend into the vertical main connector body and overlap with the first plurality of horizontal connectors to define overlapping end portions. Each connector fastener extends through the vertical main connector body and a pair of the overlapping end portions of the first and second pluralities of horizontal connectors.

20 Claims, 17 Drawing Sheets

(56) References Cited

U.S. PATENT DOCUMENTS 4,083,536 A 4/1978 Mulitz
4,149,701 A 4/1979 Densen
4,930,754 A * 6/1990 Caron ..... E04F 11/181 256/19
4,953,830 A 9/1990 Weaver
5,354,036 A 10/1994 Brown
6,131,886 A * 10/2000 Venegas, Jr. ..... E01F 13/022 256/59
6,386,519 B1 * 5/2002 Priefert ..... E04H 17/1413 256/68
6,866,253 B1 * 3/2005 Hopper ..... A01K 3/00 256/65.09
7,866,635 B2 * 1/2011 Payne ..... E04H 17/04 256/24
8,336,862 B2 * 12/2012 Priefert ..... E04H 17/1417 256/65.11
9,066,493 B2 6/2015 Barzani
9,476,220 B2 10/2016 Williams, Sr. et al.
9,506,270 B2 11/2016 Knudsen
9,580,930 B2 * 2/2017 Sadinsky ..... E04H 17/163
9,938,747 B2 * 4/2018 Hancock ..... E04H 17/18
2002/0096673 A1 * 7/2002 Siel ..... A01K 1/0005 256/67
2004/0188667 A1 * 9/2004 Ray ..... E04H 17/18 256/67
2007/0158628 A1 * 7/2007 Tsao ..... E04H 17/1447 256/19
2008/0029748 A1 * 2/2008 Ford ..... E04H 17/1417 256/65.03
2009/0032790 A1 * 2/2009 Timms ..... A01K 3/005 256/25
2009/0032792 A1 * 2/2009 Ford ..... E04F 11/1834 256/67
2009/0314220 A1 12/2009 Groh et al.
2011/0290194 A1 * 12/2011 Gardner ..... E04H 17/18 119/502

* cited by examiner

SYSTEMS, APPARATUSES, AND METHODS FOR KNOCKDOWN LIVESTOCK FENCING

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application which is hereby incorporated by reference: U.S. Provisional Application No. 62/731,380 filed Sep. 14, 2018, entitled "SYSTEMS, APPARATUSES, AND METHODS FOR KNOCKDOWN LIVESTOCK FENCING."

BACKGROUND

1. Field of the Invention

The present disclosure relates generally to livestock fencing. More particularly, this present disclosure pertains to systems, apparatuses, and methods for a knockdown livestock fence which is modular and customizable.

2. Description of the Prior Art

Traditional livestock fences are fully welded one-piece structures that can be made in dimensions as wide as 16 feet. These fences can be used as gates when hingedly coupled to a support post or as fencing panels when rigidly coupled between two support posts. These fences are traditionally made from steel tubing and feature continuous welded saddle joints. These fences can be very bulky to transport and ship due to their length and one-piece configuration. The length of these fences can be directly related to the shipping costs, with a longer fences having higher shipping costs. These fences can also take up an extensive amount of storage space at warehouses, stores, etc. These fences also come in standardized lengths which can present certain problems for a consumer with special sizing needs. Finally, these fences can be particularly hard for the consumer to transport and install.

Accordingly, a need exists for an alternative livestock fence design that provides a legitimate solution to the problems associated with shipping, storing, transporting, installing, and sizing said livestock fences. The present disclosure provides such a solution.

BRIEF SUMMARY

This disclosure provides a knockdown fence assembly that has numerous advantages over prior livestock fencing gates. One such advantage of the knockdown fence is that it is customizable and its length may be easily adjusted to meet a user's needs. Another advantage of the knockdown fence is that any length gate can be collapsed and stored in a collapsed configuration. A further advantage is that the knockdown fence takes up considerably less room in the collapsed configuration and thereby decreases shipping costs and storage space requirements associated with traditional livestock fencing gates. The knockdown fence comes collapsed and boxed to avoid damage to the painted surfaces during shipping and delivery. Another advantage of the knockdown fence is that it can be easily packaged for transportation and delivery to a set up site. The knockdown fence in the collapsed position makes the fence more easily transportable by a single user. The knockdown fence can also advantageously be setup and installed by a single person based on its configuration. For example, the knockdown fence can be assembled while laying on the ground or can be assembled incrementally outward from a support post.

One aspect of the embodiments disclosed herein is a knockdown fence assembly comprising a first end piece, a first connector piece, a first plurality of horizontal connectors, a second plurality of horizontal connectors, and a plurality of connector fasteners. The first end piece includes a vertical main body and a plurality of horizontal support pieces that extend from the vertical main body in the same direction. The first connector piece includes a vertical main connector body, a first plurality of horizontal connector support pieces and a second plurality of horizontal connector support pieces. The first and second pluralities of horizontal connector support pieces extend from the vertical main connector body in opposite directions. The first plurality of horizontal connectors are coupled between the plurality of horizontal support pieces of the first end piece and the first plurality of horizontal connector support pieces of the first connector piece. The first plurality of horizontal connectors extend into the vertical main connector body of the first connector piece. The second plurality of horizontal connectors also extend into the vertical main connector body of the first connector piece and overlap with respective horizontal connectors of the first plurality of horizontal connectors to define overlapping end portions of the first and second pluralities of horizontal connectors. Each connector fastener of the plurality of connector fasteners extends through the vertical main connector body and respective overlapping end portions of the first plurality of horizontal connectors and the second plurality of horizontal connectors.

Another aspect of the embodiments disclosed herein is a method of assembling the knockdown fence. The method includes the step of providing a first connector piece. The first connector piece includes a main connector body that extends in a first direction and a plurality of pairs of connector support pieces that extend from the main connector body in opposite directions parallel to a second direction. The second direction is perpendicular to the first direction. Each pair of connector support pieces includes a left connector support piece and a right connector support piece. The method further includes receiving a first left pipe into the left connector support piece of a first one of the pairs of connector support pieces. The first left pipe extends into the main connector body. The method further includes receiving a first right pipe into the right connector support piece of the first one of the pairs of connector support pieces. The first right pipe extends into the main connector body and overlaps with the first left pipe. The method further includes inserting a fastener through the main connector body in a third direction to bind the first left pipe and the first right pipe to the main connector body. The third direction is perpendicular to both the first direction and the second direction.

Numerous other objects, features, and advantages of the present invention will be readily apparent to those skilled in the art upon a reading of the following disclosure when taken in conjunction with the accompanying drawings.

DETAILED DESCRIPTION

Figure 1:
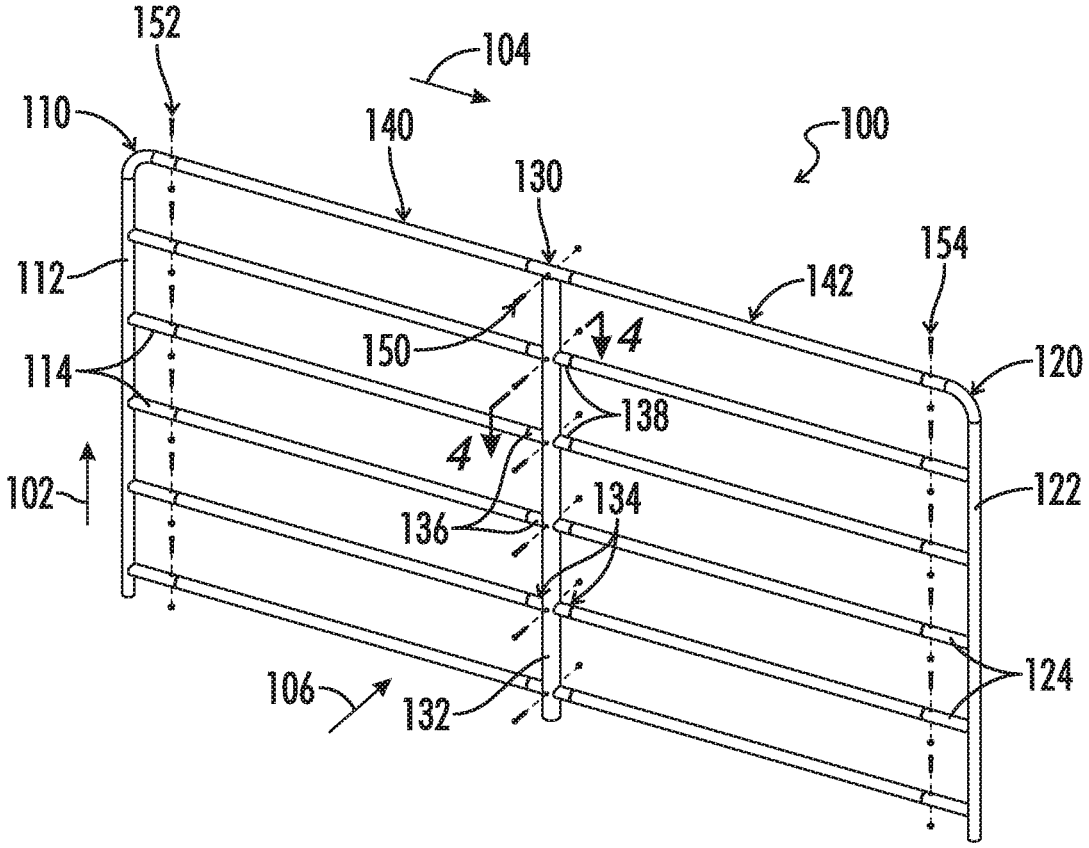
FIG. 1 is a perspective view of a knockdown fence assembly in accordance with the present disclosure.

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The words "connected", "attached", "joined", "mounted", "fastened", and the like should be interpreted to mean any manner of joining two objects including, but not limited to, the use of any fasteners such as screws, nuts and bolts, bolts, pin and clevis, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof; and the like.

Unless specifically stated otherwise, any part of the apparatus of the present disclosure may be made of any appropriate or suitable material including, but not limited to, metal, alloy, polymer, polymer mixture, wood, composite, or any combination thereof.

Referring to FIGS. 1-5, an embodiment of a knockdown fence assembly 100 is provided. The knockdown fence assembly 100 may be used as a gate, or as a section of a fence. The knockdown fence assembly 100 may also be referred to herein as a knockdown gate assembly 100. The knockdown fence assembly 100 comprises a first end piece 110, a second end piece 120, a first connector piece 130, a first plurality of horizontal connectors 140 and a second plurality of horizontal connectors 142. The first plurality of horizontal connectors 140 may also be referred to herein as a plurality of left pipes 140 or a first plurality of straight connectors 140. The second plurality of horizontal connectors may also be referred to herein as a plurality of right pipes 142 or a second plurality of straight connectors 142.

The first end piece 110 includes a main body 112 and a plurality of support pieces 114 extending from the main body 112 in the same direction. The main body 112 may also be referred to herein as a vertical main body 112. The plurality of support pieces 114 may also be referred to herein as a plurality of horizontal support pieces 114. The main body 112 of the first end piece 110 extends in a first direction 102. The plurality of support pieces 114 extend perpendicularly from the main body 112 and are oriented parallel to a second direction 104. The second direction 104 is a perpendicular to the first direction 102.

The second end piece 120 is substantially similar to the first end piece 110. The second end piece includes a main body 122 and a plurality of support pieces 124 extending from the main body 122 in the same direction. The main body 122 of the second end piece 120 may also be referred to herein as a vertical main body 122. The plurality of support pieces 124 may also be referred to herein as a plurality of horizontal support pieces 124. The main body 122 of the second end piece 120 extends in the first direction 102. The plurality of connector support pieces 124 extend perpendicularly from the main body 122 and are oriented parallel to the second direction 104.

The first connector piece 130 includes a main connector body 132 and a plurality of pairs of connector support pieces 134. The main connector body 132 may also be referred to herein as a vertical main connector body 132. The main connector body 132 extends in the first direction 102. The plurality of pairs of connector support pieces extend perpendicularly from the main connector body 132 in opposite directions and are oriented parallel to the second direction 104. The plurality of pairs of connector support pieces 134 includes a plurality of left connector support pieces 136 and a plurality of right connector support pieces 138. Accordingly, each pair of connector support pieces includes a left connector support piece and a right connector support piece. The plurality of left connector support pieces 136 may also be referred to herein as a first plurality of horizontal connector support pieces 136. The plurality of right connector support pieces 138 may also be referred to herein as a second plurality of horizontal connector support pieces 138.

The first plurality of horizontal connectors 140 are coupled between the plurality of support pieces 114 of the first end piece 110 and the plurality of the left connector support pieces 136 of the first connector piece 130. The second plurality of horizontal connectors 142 may be coupled between the plurality of support pieces 124 of the first end piece 120 and the plurality of the right connector support pieces 138 of the first connector piece 130.

Figure 4A:
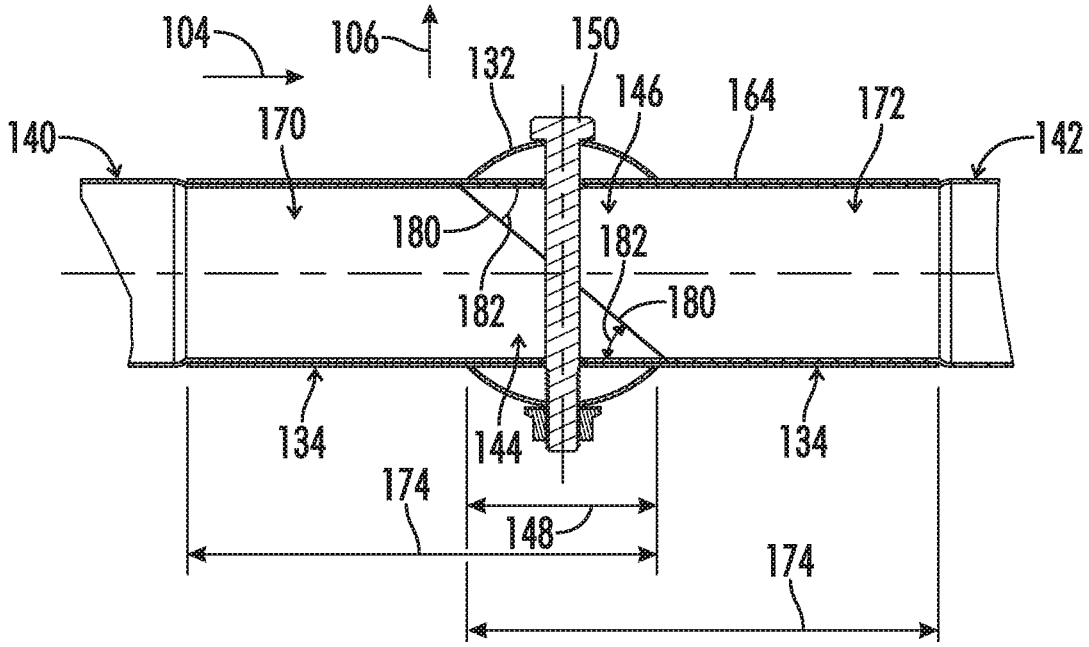
FIG. 4A is a cross-sectional plan view of a first embodiment of a first connector piece and horizontal connectors of the knockdown fence assembly of FIG. 1 taken along line 4-4 of FIG. 1, with the ends of the horizontal connectors having beveled cuts.
Figure 4B:
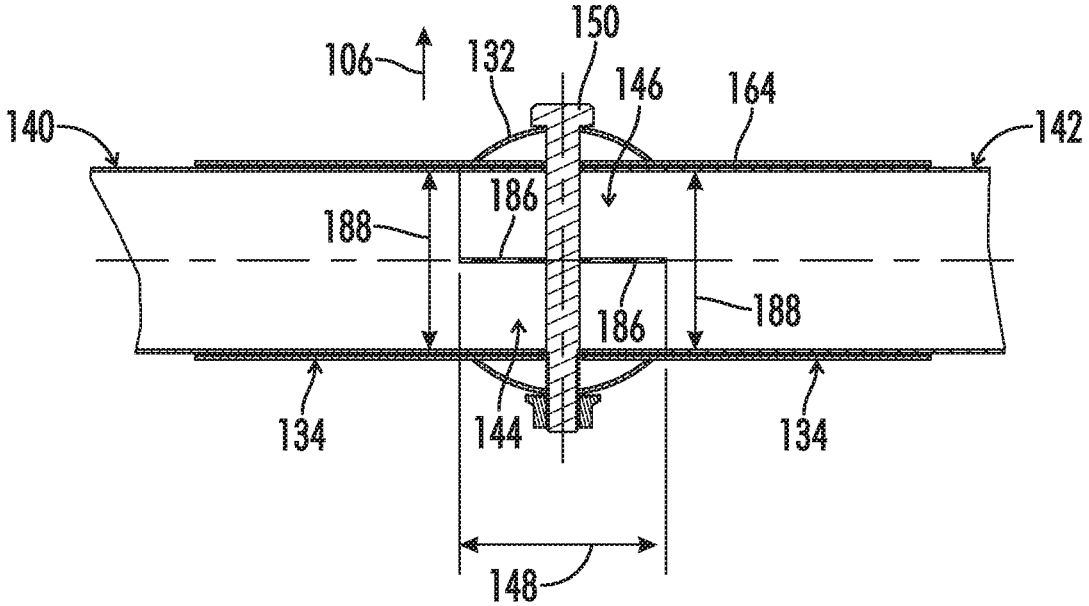
FIG. 4B is a cross-sectional plan view of a second embodiment of a first connector piece and the horizontal connectors of the knockdown fence assembly of FIG. 1 taken along line 4-4 of FIG. 1, with overlapping ends of the horizontal connectors having stepped profiles in accordance with the present disclosure.
Figure 4C:
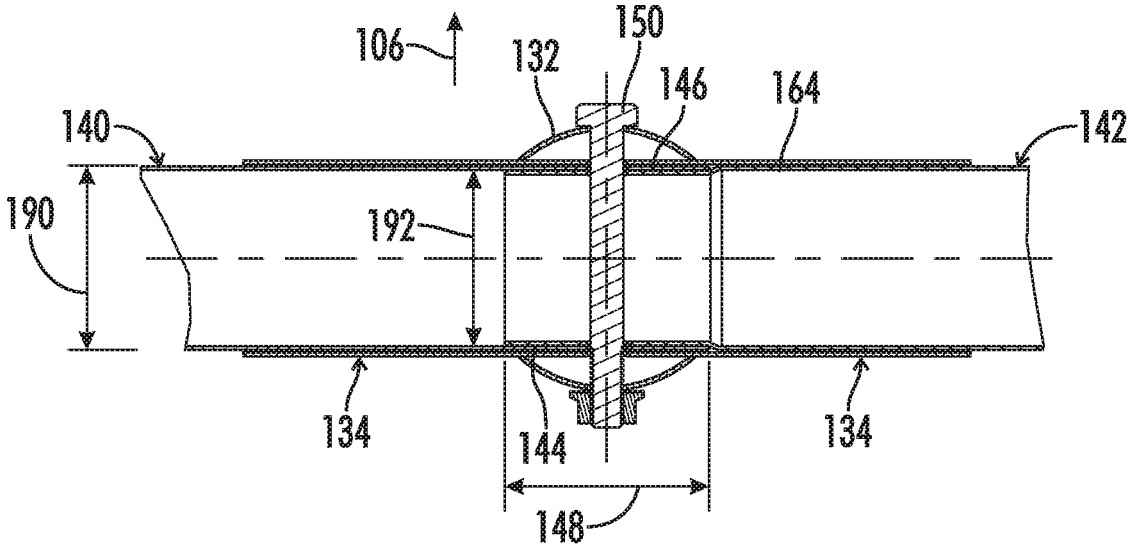
FIG. 4C is a cross-sectional plan view of a third embodiment of a first connector piece and the horizontal connectors of the knockdown fence assembly of FIG. 1 taken along line 4-4 of FIG. 1, with one of the horizontal connectors receive the other horizontal connector in accordance with the present disclosure.

As can best be seen in FIGS. 4A-4C, the first plurality of horizontal connectors 140 extend into the main connector body 132 of the first connector piece 130. The second plurality of horizontal connectors 142 extend into the main connector body 132 of the first connector piece and overlap with respective horizontal connectors of the first plurality of horizontal connectors 140 to define overlapping end portions 144, 146 of the first and second pluralities of horizontal connectors 140, 142, respectively. The overlapping end portions 144, 146 of the first and second pluralities of horizontal connectors 140, 142, respectively, include a common length 148.

The knockdown fence assembly 100 further includes a plurality of connector fasteners 150 to bind or fasten the first and second pluralities of horizontal connectors 140, 142 to the first connector piece 130. Each connector fastener of the plurality of connector fasteners 150 is configured to extend through the main connector body 132 of the first connector piece 130 and respective overlapping end portions 144, 146 of the first and second pluralities of horizontal connectors 140, 142. The knockdown fence assembly 100 may further include a plurality of first end fasteners 152 and a plurality of second end fasteners 154 to bind or fasten the first and second pluralities of horizontal connectors 140, 142 to the first or second end pieces 110, 120, respectively. Each first end fastener of the plurality of first end fasteners 152 extends through one of the plurality of support pieces 114 of the first end piece and one of the first plurality of horizontal connectors 140. Each second end fastener of the plurality of second end fasteners 154 extends through one of the plurality of horizontal support pieces 124 of the second end piece 120 and one of the second plurality of horizontal connectors 142. The plurality of first end fasteners 152 and the plurality of second end fasteners 154 may be oriented parallel to the first direction 102. The plurality of connector fasteners 150 are oriented parallel to a third direction 106. The third direction 106 is perpendicular to both the first direction 102 and the second direction 104. The plurality of connector fasteners 150, the plurality of first end fasteners 152, and the plurality of second end fasteners 154 may be identical.

Figure 3:
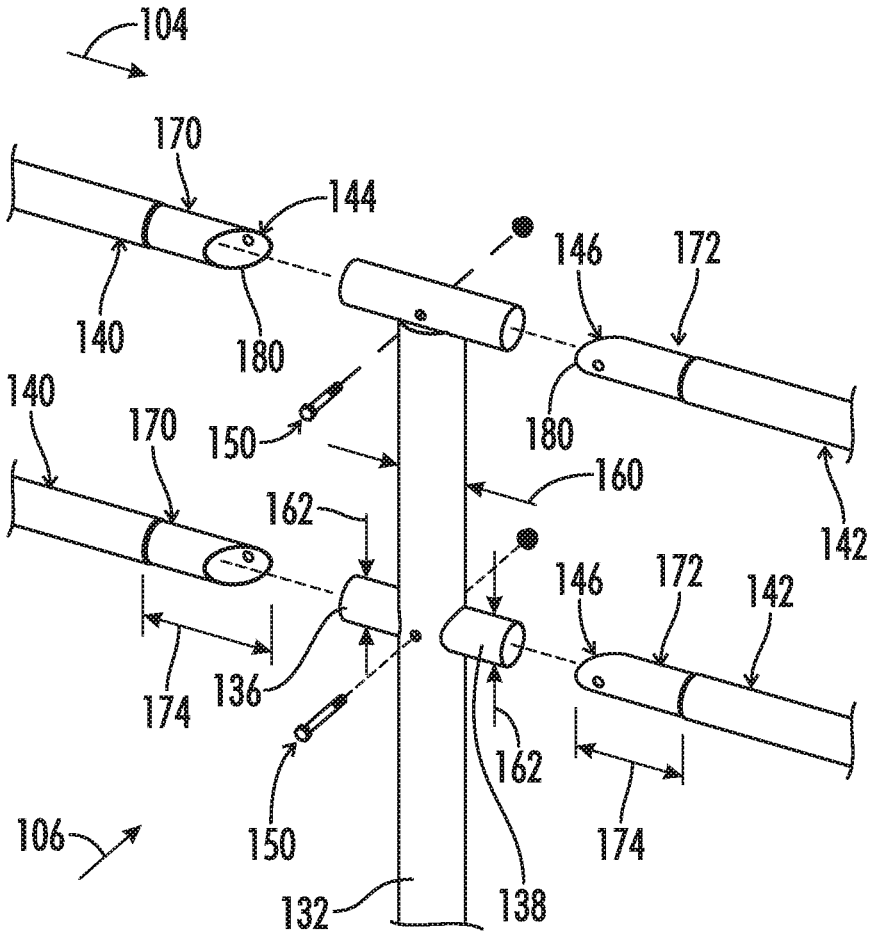
FIG. 3 is an enlarged perspective view of the knockdown fence assembly of FIG. 1 taken of area 3-3 of FIG. 2.

As can best be seen in FIG. 3, the main connector body 132 of the first connector piece 130 includes a main connector body diameter 160. Each of the plurality of left connector support pieces 136 of the first connector piece 130 and each of the plurality of right connector support pieces 138 of the first connector piece 130 include a connector support diameter 162. The connector support diameter 162 may be smaller than the main connector body diameter 160. Accordingly, and as can best be seen in FIGS. 4A-4C, each of the plurality of pairs of connector support pieces 134 of the first connector support piece 130 may be formed by a continuous pipe 164 that extends through the main connector body 132 of the first connector piece 130. By forming each of the plurality of pairs of connector support pieces 134 with the continuous pipe 164, the overall strength of the knockdown fence assembly 100 is increased because the overlapping end portions 144, 146 cannot move within the main connector body 134 of the first connector piece 130. Accordingly, any flexion of the knockdown fence assembly 100 is also reduced.

Figure 8:
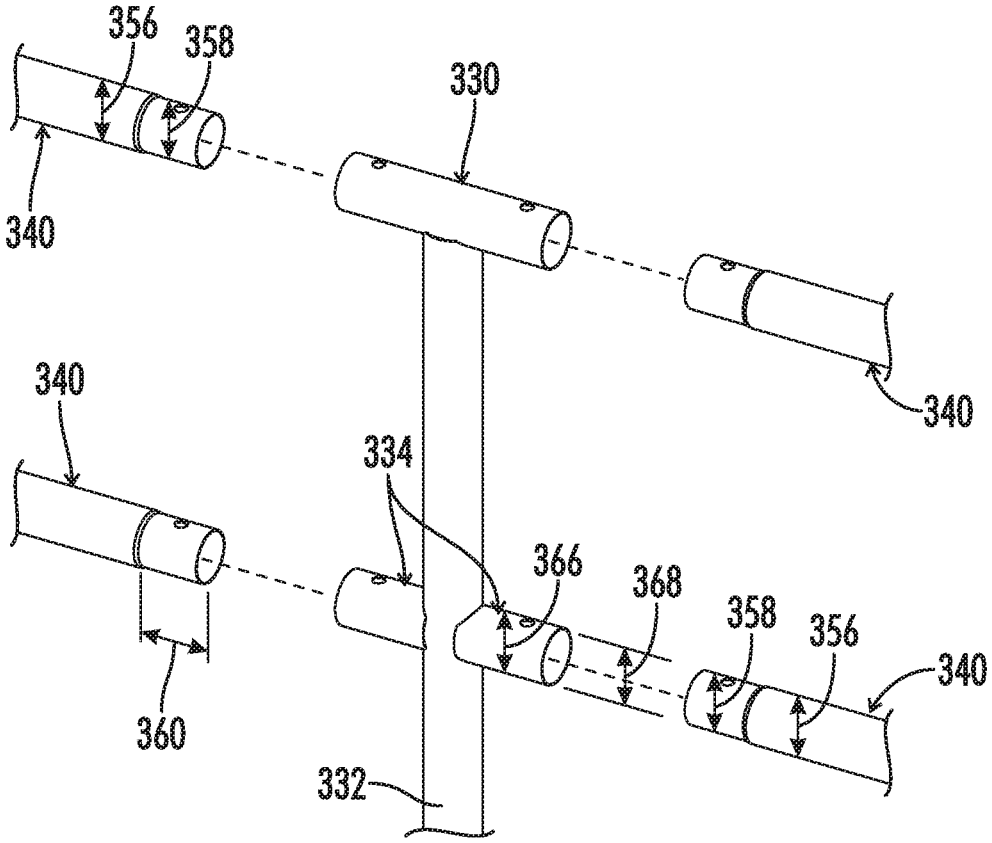
FIG. 8 is an enlarged perspective view of the knockdown fence assembly of FIG. 6 taken of area 8-8 of FIG. 7.

Alternatively, the main connector body diameter 160 may be made equal to the connector support diameter 162, in which case the pairs of connector support pieces 134 may be individually welded to the main connector body 132 in a manner similar to that of the connector piece 330 shown in FIG. 8 and further described below.

Figure 2:
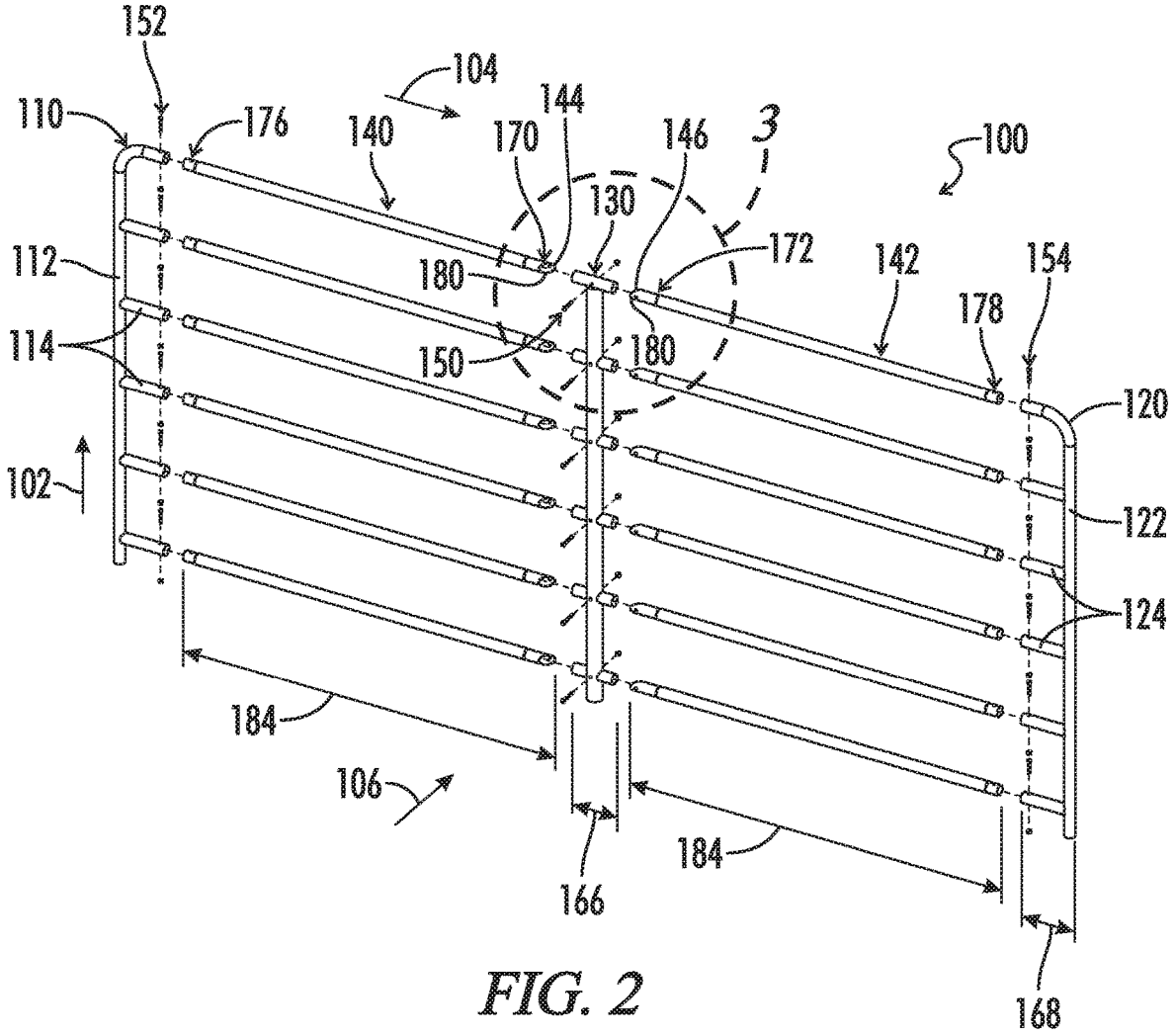
FIG. 2 is an exploded perspective view of the knockdown fence assembly of FIG. 1.

As can best be seen in FIG. 2, the first connector piece 130 further includes a connector piece width 166 defined between free ends of the plurality of left connector support pieces 136 and free ends of the plurality of right connector support pieces 138. The connector piece width 166 may be less than or equal a common number of horizontal connectors of the first and second pluralities of horizontal connectors 140, 142 multiplied by a common horizontal connector diameter of the first and second pluralities of horizontal connectors 140, 142.

The first and second end pieces 110, 120 may further include an end piece width 168 defined between free ends of the plurality of support pieces 114, 124 and an outer periphery of the main body 112, 122 of the first and second end pieces 110, 120, respectively, opposite the free ends. The end piece width 168 may be less than or equal to the common number of horizontal connectors of the first and second pluralities of horizontal connectors 140, 142 multiplied by the common horizontal connector diameter of the first and second pluralities of horizontal connectors 140, 142.

As can best be seen in FIGS. 3 and 4A, in one embodiment each of the first plurality of horizontal connectors 140 includes a first reduced diameter end portion 170 that includes the overlapping end portions 144. Each of the second plurality of horizontal connectors 142 includes a first reduced diameter end portion 172 that includes the overlapping end portions 146. The first and second reduced diameter end portions 170, 172 include a common reduced diameter end portion length 174. The common reduced diameter end portion length 174 may be substantially equal to a summation of one-half of the connector piece width 166 and one-half of the common length 148 of the overlapping end portions 144, 146.

As can best be seen in FIG. 2, each of the first plurality of horizontal connectors 140 further includes a second reduced diameter end portion 176 positioned opposite the first reduced first diameter end portion 170. Each of the second plurality of horizontal connectors 142 further includes a second reduced diameter end portion 178 positioned opposite the first reduced first diameter end portion 172. The second reduced diameter end portion 176 of each of the first plurality of horizontal connectors 140 is received in one of the plurality of support pieces 114 of the first end piece 110. The second reduced diameter end portion 178 of each of the second plurality of horizontal connectors 142 may be received in one of the plurality of support pieces 124 of the second end piece 120. The first end fastener 152 may be received through the second reduced diameter end portions 176 of the first plurality of horizontal connectors 140 to bind them to the plurality of support pieces 114 of the first end piece 110. The second end fasteners 154 may be received through the second reduced diameter end portions 178 of the second plurality of horizontal connectors 142 to bind them to the plurality of support pieces 124 of the second end piece 120.

As can be best be seen in FIGS. 2 and 4A, the overlapping end portions 144, 146 of the first and second pluralities of horizontal connectors 140, 142, respectively, include matching beveled cuts 180. The beveled cuts 180 of the overlapping end portions 144, 146 are angled at an angle 182 relative to a common length 184 (FIG. 2) of the first and second pluralities of horizontal connectors 140, 142, respectively. The angle 182 may be less than or equal to sixty (60) degrees, in order to provide enough bite for each of the connector fasteners 150 to extend through both overlapping end portions 144, 146. In certain embodiments, the angle 182 may be between thirty (30) and forty-five (45) degrees.

As can best be seen in FIG. 4B, in another embodiment the overlapping end portions 144, 146 of the first and second pluralities of horizontal connectors 140, 142, respectively, include matching semi-cylindrical cuts 186. The semi-cylindrical cuts 186 of the overlapping end portions 144, 146 are defined along the common length 148. In such an embodiment, the common length 148 is at least as long as a diameter 188 of the matching semi-cylindrical cuts 186.

As can best be seen in FIG. 4C, in still another embodiment each overlapping end portion 144 of the first plurality of horizontal connectors 140 includes a first diameter 190. Each overlapping end portion 146 of the second plurality of horizontal connectors includes a second diameter 192. The second diameter 192 may be smaller than the first diameter 190. In such an embodiment, the overlapping end portions 144 of the first plurality of horizontal connectors 140 are configured to concentrically receive the overlapping end portions 146 of the second plurality of horizontal connectors 142. Furthermore, in such an embodiment, the common length 148 of the overlapping end portions 144, 146 of the first and second pluralities of horizontal connectors 140, 142 may be greater than or equal to the connector support diameter 162.

Although the overlapping end portions 144, 146 of the first and second of pluralities of connectors 140, 142 have been described herein as having various shapes in various embodiments, they may be shaped differently in further embodiments and still accomplish the same purpose of allowing the connector fasteners to extend through both overlapping end portions 144, 146 to bind those end portions to the main connector body 132 of the first connector piece 130.

Figure 5:
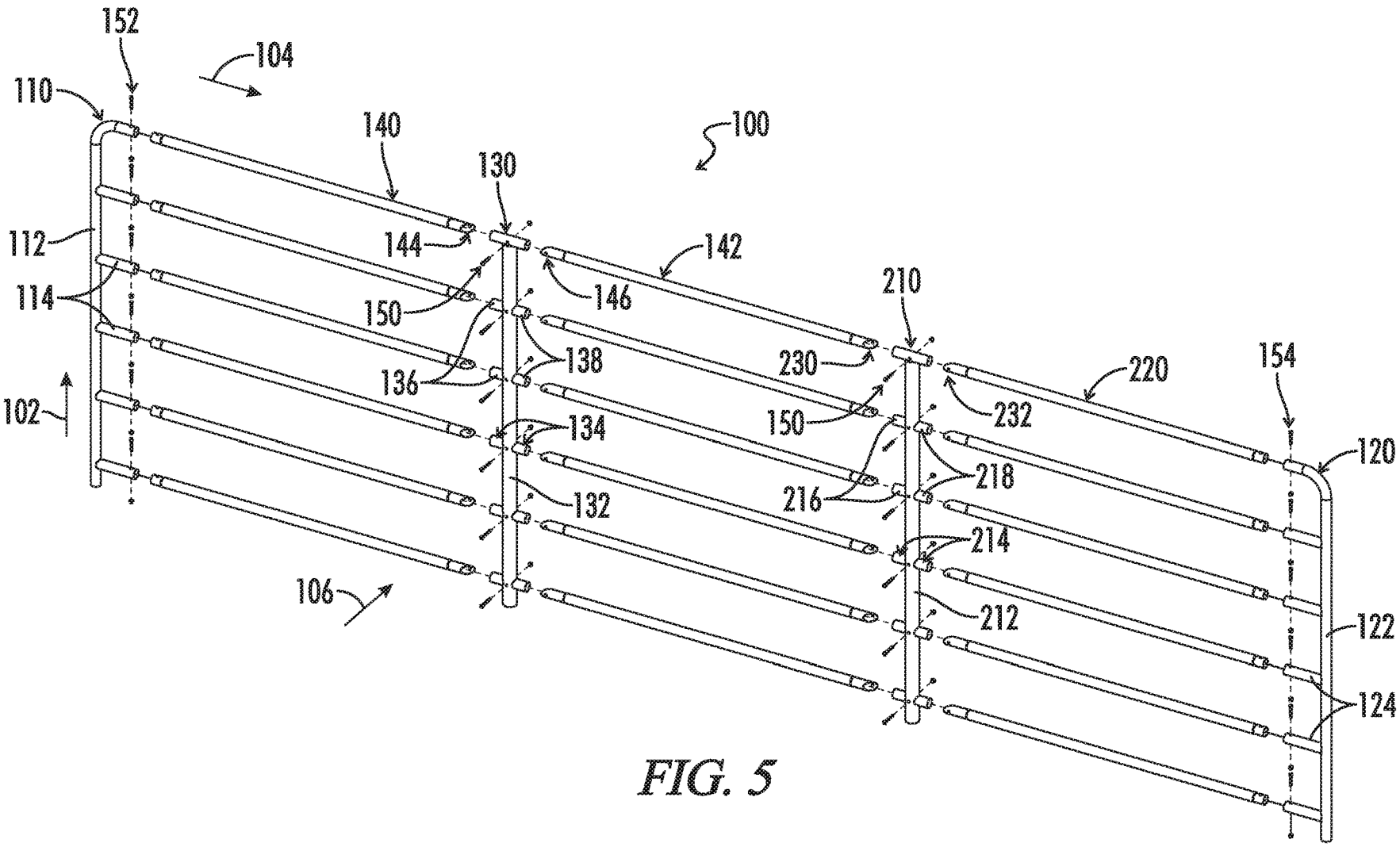
FIG. 5 is an exploded perspective view of the knockdown fence assembly of FIG. 1 including a second connector piece in accordance with the present disclosure.
Figure 6:
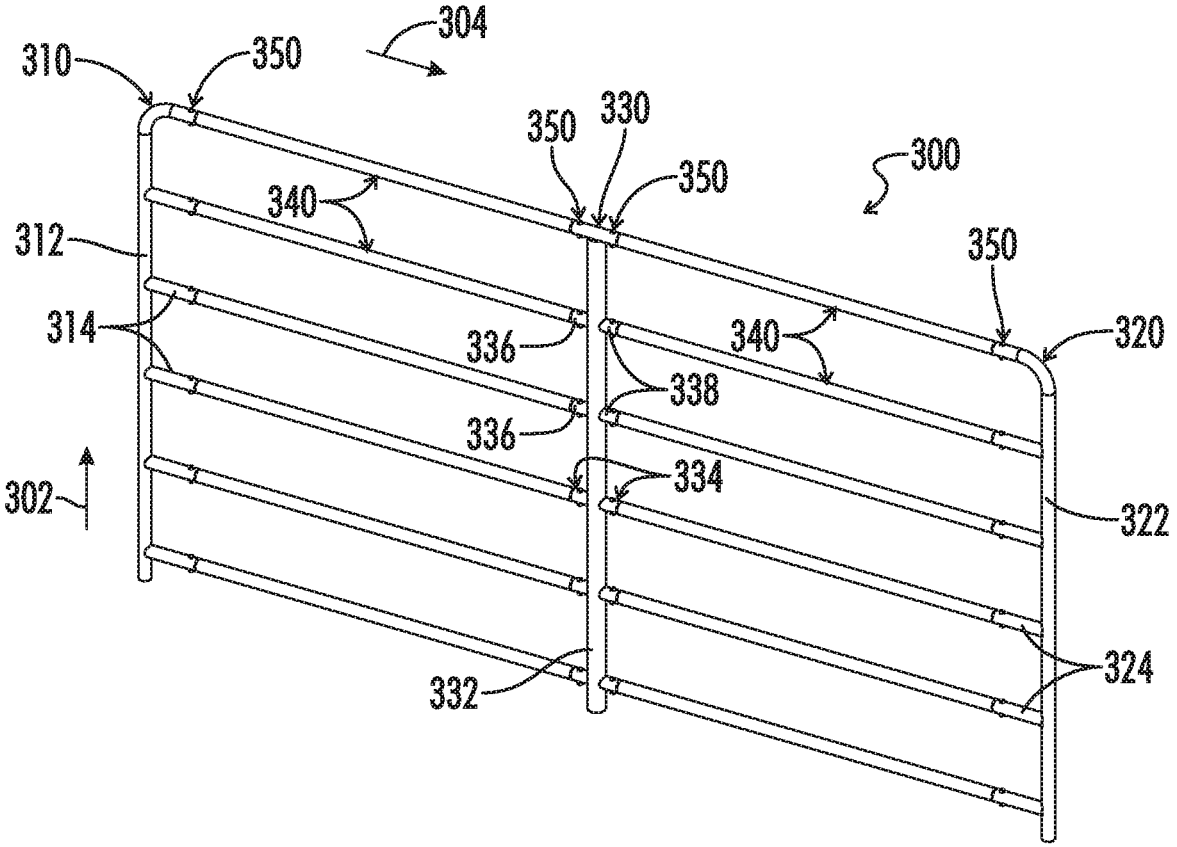
FIG. 6 is a perspective view of another embodiment of a knockdown fence assembly in accordance with the present disclosure.

In certain embodiments, as can best be seen in FIG. 5, the knockdown fence assembly 100 may further comprise a second connector piece 210 and a third plurality of horizontal connectors 220. The second connector piece 210 is substantially similar to the first connector piece 130. The second connector piece 210 may be positioned between the first connector piece 130 and the second end piece 120. The second connector piece 210 includes a main connector body 212 and a plurality of pairs of connector support pieces 214. The main connector body 212 extends in the first direction 102. The plurality of pairs of connector support pieces 214 extend from the main connector body 212 in opposite directions parallel to the second direction 104. The plurality of pairs of connector support pieces 214 include a plurality of left connector support pieces 216 and a plurality of right connector support pieces 218. Accordingly, each pair of connector support pieces includes a left connector support piece and a right connector support piece. In such an embodiment, the second plurality of horizontal connectors 142 are coupled between the plurality of right connector support pieces 138 of the first connector piece 130 and the plurality of left connector support pieces 216 of the second connector piece 210. The second plurality of horizontal connectors 142 may extend into the main connector body 212 of the second connector piece 210. The third plurality of horizontal connectors 220 are coupled between the plurality of right connector support pieces 218 of the second connector piece 210 and the plurality of support pieces 124 of the second end piece 120. The third plurality of horizontal connectors 220 are configured to extend into the main connector body 212 of the second connector piece 210 and overlap with respective horizontal connectors of the second plurality of horizontal connectors 142 to defined a second overlapping end portion 230 of the second plurality of horizontal connectors 142 and an overlapping end portion 232 of the third plurality of horizontal connectors 220. The second overlapping end portion 230 of each of the second plurality of horizontal connectors 142 and the overlapping end portion 232 of each of the third plurality of horizontal connectors 220 are defined similarly to the overlapping end portions 144, 146 of the first and second pluralities of horizontal connectors 140, 142. Accordingly, further description of these overlapping end portions 230, 232 is unnecessary in light of the above description. The third plurality of horizontal connectors 220 may include reduced diameter end portions that are similar to those of the first and second pluralities of horizontal connectors 140, 142 when present.

When the knockdown fence assembly 100 is used as a gate, it may include hinge brackets coupled to the main body 112, 122 of one of the first end piece 110 or the second end piece 120 and a latch mechanism coupled to the other one of the end pieces 110, 120. The hinge brackets and the latch mechanism used with the knockdown fence assembly 100 may be the same as those described below regarding FIGS. 17-20. When the knockdown fence assembly 100 is used as a fence, it may include mounting brackets coupled to the main bodies 112, 122 of each of the first and second end pieces 110, 120.

A method of assembling the knockdown fence assembly 100 is further described herein. The method of assembly comprises providing the first connector piece 130 with the plurality of pairs of connector support pieces 134 aligned in the second direction 104. The method of assembly further comprises receiving the first plurality of horizontal connectors 140 into respective connector support pieces of the plurality of left connector support pieces 136 of the first connector piece 130, such that the first plurality of horizontal connectors 140 extend into the main connector body 132 of the first connector piece 130. The method of assembly further comprises receiving the second plurality of horizontal connectors 142 into respective connector support pieces of the plurality of right connector support pieces 138 of the first connector piece 130, such that the second plurality of horizontal connectors 142 extend into the main connector body 132 of the first connector piece 130 and overlap with respective connectors of the first plurality of horizontal connectors 140. The method of assembly further includes inserting the plurality of connector fasteners 150 through the main connector body 132 in the third direction 106 to bind the first and second pluralities of horizontal connectors 140, 142 to the main connector body 132 of the first connector piece 130.

The method of assembly may further comprise providing the first end piece 110 with the plurality of support pieces 114 aligned parallel with the second direction 104 and receiving the first plurality of horizontal connectors 140 into respective support pieces of the plurality of support pieces 114 of the first end piece 110.

The method of assembly may further comprise providing the second end piece 120 with the plurality of support pieces 124 aligned parallel with the second direction 104 and receiving the second plurality of horizontal connectors 142 into respective support pieces of the plurality of support pieces 124 of the second end piece 120.

The method of assembly may further comprise providing the second connector piece 210 with the plurality of pairs of connector support pieces 214 aligned parallel with the second direction 104 and positioning the second connector piece 210 between the first connector piece 130 and the second end piece 120. The method of assembly may further comprise receiving the second plurality of horizontal connectors 142 into the plurality of the left connector support pieces 216 of the second connector piece 210 with the second plurality of horizontal connectors 142 extending into the main connector body 212 of the second connector piece 210. The method of assembly may further comprise receiving the third plurality of horizontal connectors 220 into respective connector support pieces of the plurality of right connector support pieces 218 of the second connector piece 210 with the third plurality of horizontal connectors 220 extending into the main connector body 212 of the second connector piece 210. The method of assembly may further include receiving the third plurality of horizontal connectors 220 into respective support pieces of the plurality of support pieces 124 of the second end piece 120.

The method of assembly may further comprise any and all additional steps necessary to bind the respective pieces of the knockdown fence assembly 100 together, as well as add rigidity and strength to the knockdown fence assembly 100.

Referring to FIGS. 6-10, another embodiment of a knockdown fence assembly 300 is provided. The knockdown fence assembly 300 may also be referred to herein as a knockdown gate assembly 300. The knockdown fence assembly 300 comprises a first end piece 310, a second end piece 320, a first connector piece 330, a plurality of straight connectors 340 and a plurality of fasteners 350. The plurality of straight connectors 340 may also be referred to herein as a plurality of horizontal connectors 340.

The first end piece 310 includes a main body 312 and a plurality of support pieces 314. The main body 312 may extend in a first direction 302. The plurality of support pieces 314 extend perpendicularly from the main body 312. The plurality of support pieces 314 may be oriented parallel to a second direction 304. The second direction 304 is perpendicular to the first direction 302. The second end piece 320 includes a main body 322 and a plurality of support pieces 324. The main body 322 may extend in the first direction 302. The plurality of support pieces 324 extend perpendicularly from the main body 322. The plurality of support pieces 324 may be oriented parallel to the second direction 304.

The first connector piece 330 may be positioned between the first and second end pieces 310, 320. The first connector piece 330 includes a main connector body 332 and a plurality of pairs of connector support pieces 334. The main connector body 332 may extend in the first direction 302. The plurality of pairs of support pieces 334 extend perpendicularly from the main connector body 332 in opposite directions. The plurality of pairs of support pieces 334 may be oriented parallel to the second direction 304. The plurality of pairs of connector support pieces 334 include a plurality of left connector support pieces 336 and a plurality of right connector support pieces 338. The plurality of left connector support pieces 336 may extend toward the first end piece 310 and the plurality of right connector support pieces 338 may extend toward the second end piece 320. The pluralities of left and right connector support pieces 336 and 338 may be welded to the main connector body 332 of the first connector piece 330.

Each straight connector of the plurality of straight connectors 340 is received in one support piece of the plurality of support pieces 314, 324 of one of the first or second end pieces 310, 320 and in one of the plurality of left connector support pieces 336 or one of the plurality of right connector support pieces 338 of one of the plurality of pairs of connector support pieces 334 of the first connector piece 330. The plurality of fasteners 350 are configured to fasten the plurality of straight connectors 340 to the first end piece 310, to the second end piece 320, and to the first connector piece 330. The plurality of fasteners 350 may be oriented parallel with the first direction 302 so as to not extend perpendicularly from the assembled knockdown fence assembly 300.

Figure 7:
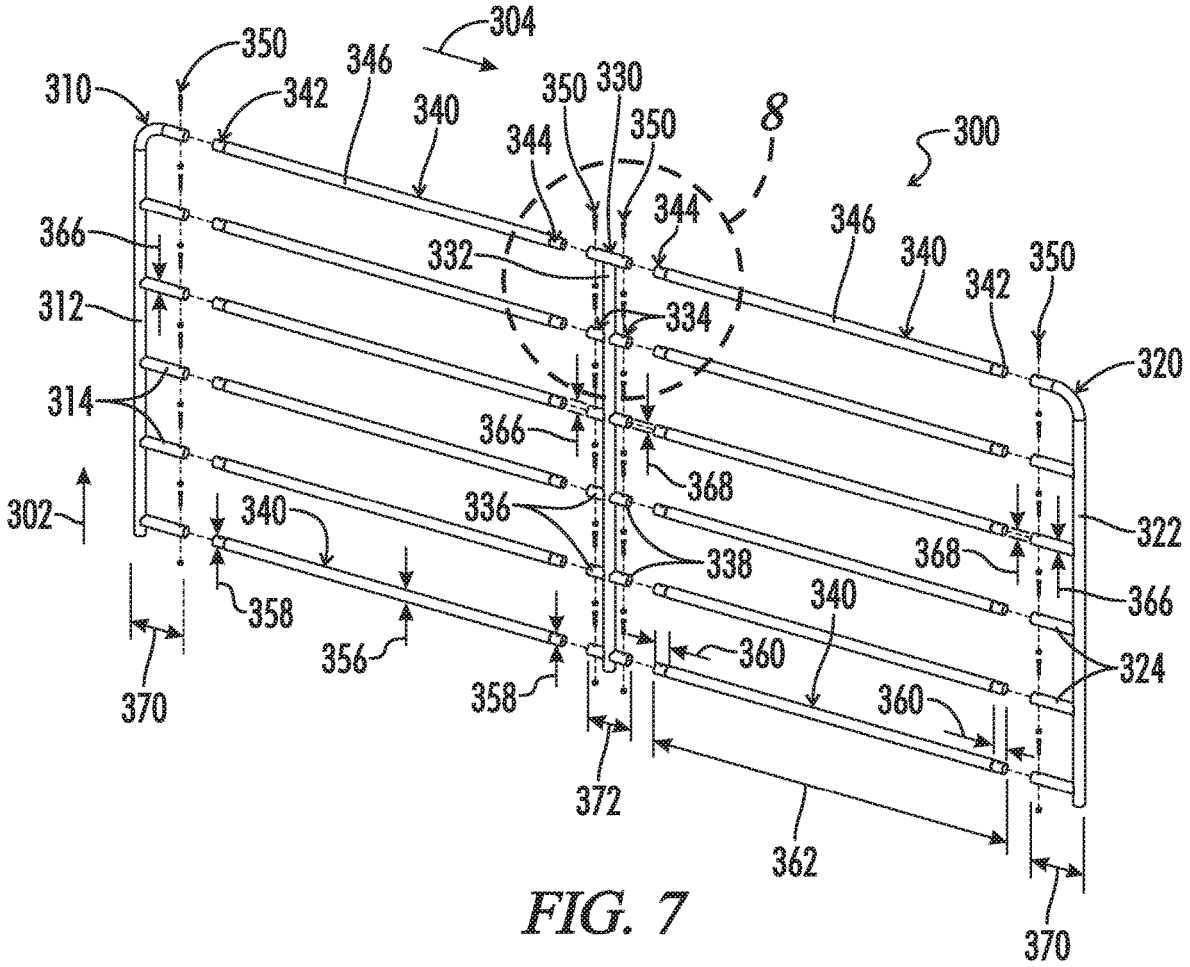
FIG. 7 is an exploded perspective view of the knockdown fence assembly of FIG. 6.

As can best be seen in FIG. 7, each straight connector of the plurality of straight connectors 340 includes a first reduced diameter end portion 342, a second reduced diameter end portion 344, and a middle portion 346 positioned between the first and second reduced diameter end portions 342, 344. The middle portion 346 may also be referred to herein as a central portion 346. The middle portion 346 includes a middle portion outer diameter 356. The first and second reduced diameter end portions 342, 344 include a common reduced outer diameter 358. Each of the first and second reduced diameters end portions 342, 344 includes a reduced diameter end portion length 360. The reduced diameter end portion length 360 is common to both of the first and second reduced diameter end portions 342, 344, however, in other embodiments, the length may differ between the first and second reduced diameter end potions 342, 344. The reduced diameter end portion length 360 is at least as long as the common reduced outer diameter 358 of the first and second reduced diameter end portions 342, 344. The plurality of straight connectors 340 include a straight connector length 362. The middle portion outer diameter 356 may be defined along a majority of the straight connector length 362.

As can best be seen in FIG. 7, each of the pluralities of support pieces 314, 324 of the first and second end pieces 310, 320, respectively, and the plurality of pairs of connector support pieces 334 of the first connector piece 330 include a common outer diameter 366 and a common inner diameter 368. The common outer diameter 366 and the common inner diameter 368 can be seen in FIG. 8 with respect to the first connector piece 340. The middle portion outer diameter 356 of the middle portion 346 of each of the plurality of straight connectors 340 may be substantially equal to the common outer diameter 366. The common reduced outer diameter 358 of the first and second reduced diameter end portions 342, 344 of each of the plurality of straight connectors 340 is less than or equal to the common inner diameter 368. The common reduced outer diameter 358 may be at least ninety-six (96%) percent of the common inner diameter 368. This ensures a snug fit between the plurality of straight connectors 340 and the support pieces 314, 324, 334 of the first end piece 310, the second end piece 320, and the first connector piece 330, respectively. Accordingly, movement and any potential flexion of the knockdown fence assembly 100 is reduced or eliminated.

As can best be seen in FIG. 7, the first and second end pieces 310, 320 include an end piece width 370. As illustrated, the end piece width 370 is common between the first and second end pieces 310, 320, however, in certain other embodiments (not shown) this width may differ. The end piece width 370 may be defined between free ends of the plurality of support pieces 314, 324 and an outer periphery of the main body 312, 322 of the first and second end pieces 310, 320, respectively, opposite the free ends. The end piece width 370 may be less than or equal to six times (e.g., or a number of straight connectors extending between the first end piece 310 and the first connector piece 330 multiplied by) the common outer diameter 366 of the support pieces 314, 324, 334. The first connector piece 330 includes a connector piece width 372 defined between opposing free ends of the plurality of pairs of connector support pieces 334. In other words, the connector piece width is defined between free ends of the plurality of left connector support pieces 336 and free ends of the plurality of right connector support pieces 338. The connector piece width 372 may be less than or equal to six times (e.g., or a number of straight connectors extending between the first end piece 310 and the first connector piece 330 multiplied by) the common outer diameter 366. These relationships are important as will be delineated below with regard to packaging the knockdown fence assembly 300.

Figure 9:
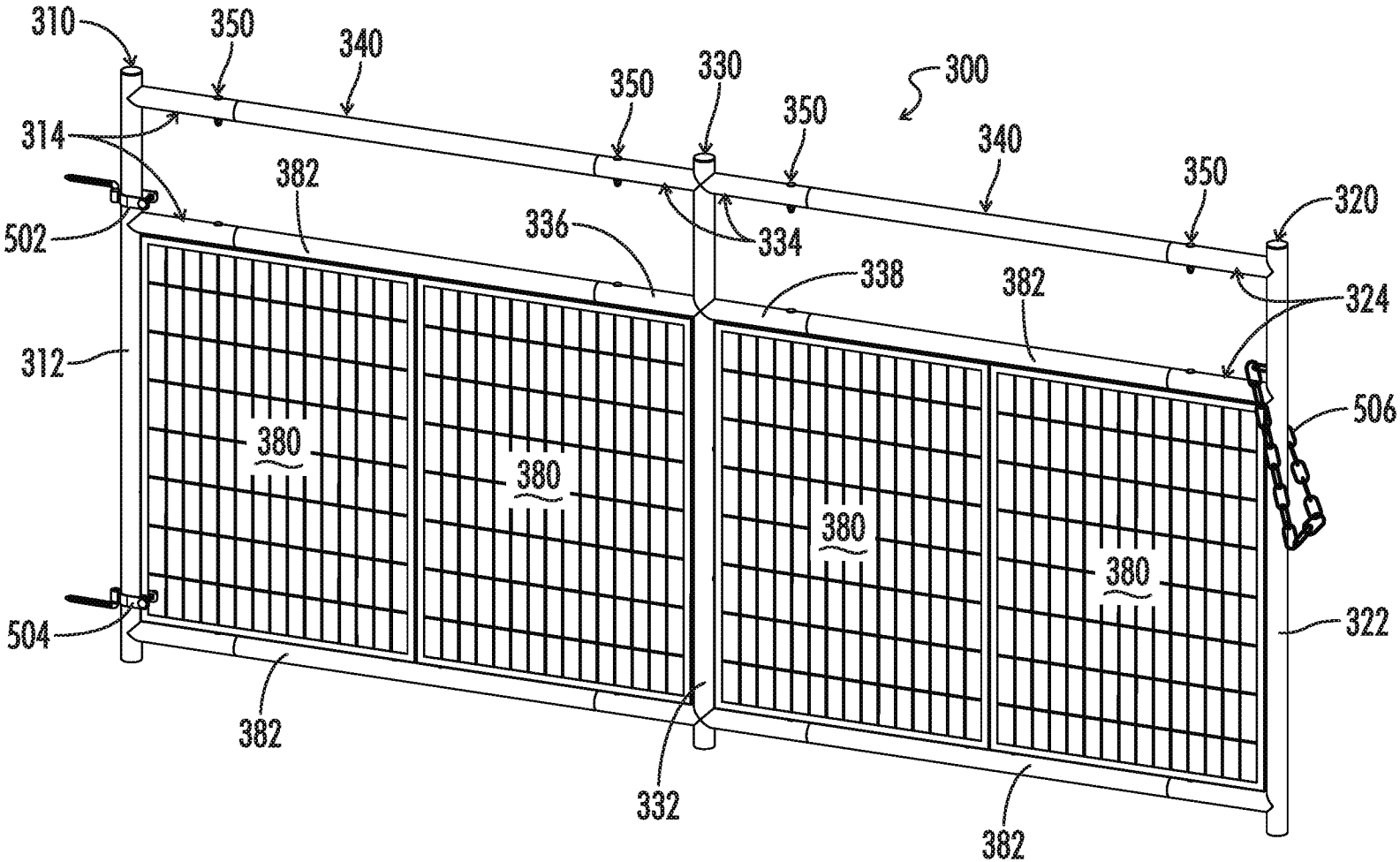
FIG. 9 is a perspective view of another embodiment of the knockdown fence assembly of FIG. 6 with at least one wire panel attached thereto in accordance with the present disclosure.

As can best be seen in FIG. 9, in another embodiment the knockdown fence assembly 300 may further comprise at least one wire panel 380. The at least one wire panel 380 may be positioned between a consecutive pair of straight connectors 382 of the plurality of straight connectors 382. The consecutive pair of straight connectors 382 may be defined as two consecutive straight connectors that are positioned on the same side of the first connector piece 330 (e.g., between one of the first end piece 310 or the second end piece 320 and the first connector piece 330). The pair of consecutive straight connectors 382 may be spaced further apart than the remainder of the plurality of straight connectors 340 positioned on the same side of the first connector piece 330. The pair of consecutive straight connectors 382 may be the two lowermost straight connectors positioned on each side of the first connector piece 330. The position of the at least one wire panel 380 may be important in order to deter or prevent animals from getting through or circumventing the knockdown fence assembly 300. Although not mentioned previously, the knockdown fence assembly 100 may also include at least one wire panel (not shown) configured similarly to at least one wire panel 380 of the knockdown fence assembly 300.

Figure 10:
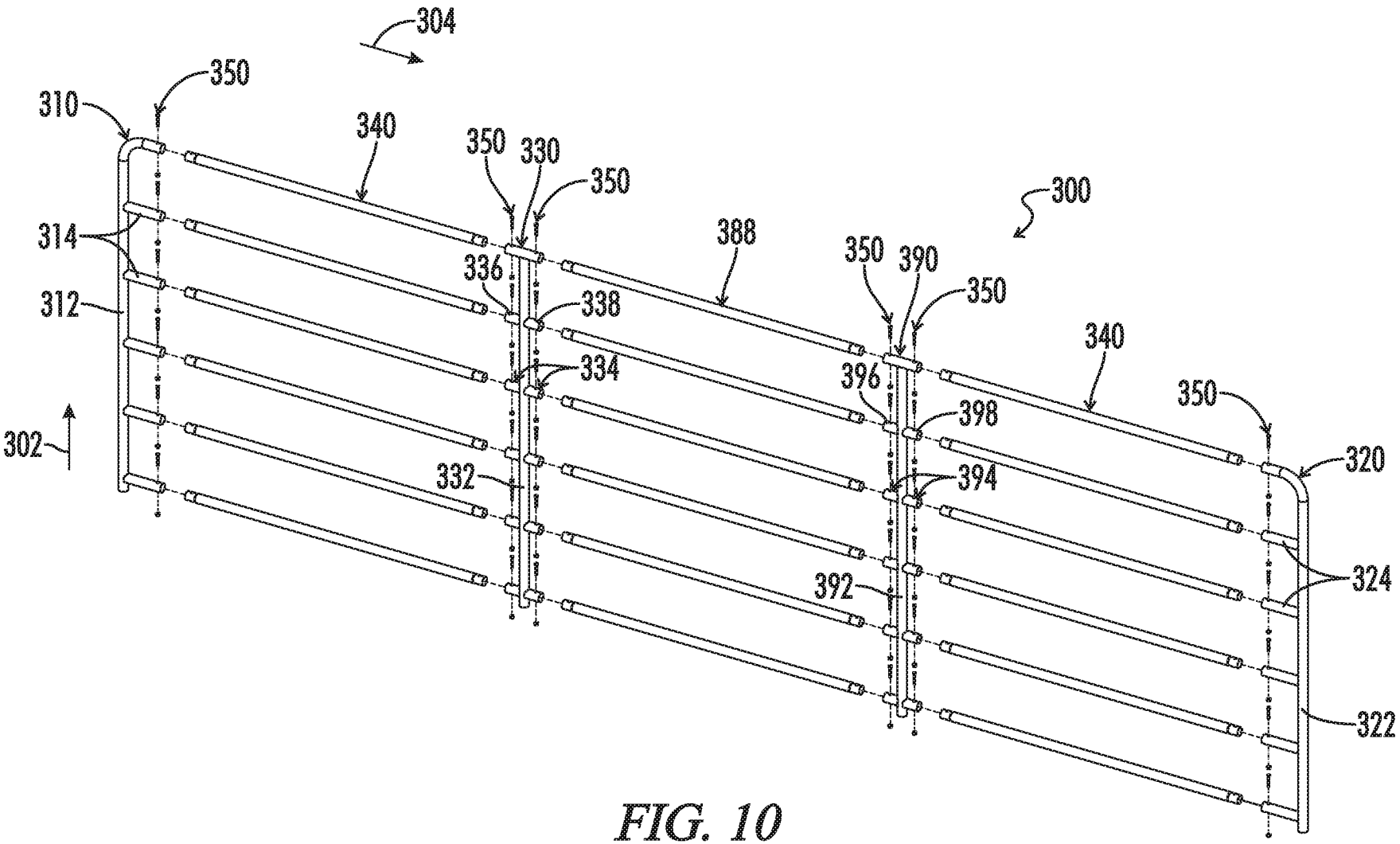
FIG. 10 is an exploded perspective view of the knockdown fence assembly of FIG. 6 including a second connector piece in accordance with the present disclosure.

As best be seen in FIG. 10, the knockdown fence assembly 300 may further comprise a second connector piece 390. The first and second connector pieces 330, 390 may be configured in series between the first and second end pieces 310, 320. The second connector piece 390 is substantially similar to the first connector piece 330. The second connector piece 390 includes a main connector body 392 and a plurality of pairs of connector support pieces 394 extending perpendicularly from the main connector body 392 in opposite directions. The main connector body 392 may be oriented parallel to the first direction 302 and the plurality of pairs of connector support pieces 394 may be oriented parallel to the second direction 304. The plurality of pairs of connector support pieces 394 include a plurality of left connector support pieces 396 and a plurality of right connector support pieces 398. The plurality of left connector support pieces 396 may extend toward the first connector piece 330 and the plurality of right connector support pieces 398 may extend toward the second end piece 320.

When the second connector piece 390 is included, the knockdown fence assembly further includes an additional plurality of straight connectors 388. Each straight connector of the additional plurality of straight connectors 388 may be received in one of the plurality of right connector support pieces 338 of the first connector piece 330 and one of the plurality of left connector support pieces 396 of the second connector piece 390. Similar to the above description, each straight connector of the plurality of straight connectors 340 may be received in one support piece of the plurality of support pieces 314, 324 of one of the first or second end pieces 310, 320 and in one of the plurality of left connector support pieces 336 of the first connector piece 330 or in one of the plurality of right connector support pieces 398 of the second connector piece 390. The plurality of straight connectors 340 may be identical to the additional plurality of straight connectors 388.

The plurality of fasteners 350 may be configured to bind the various pieces, including the second connector piece 390 and the additional plurality of straight connectors 388, of the knockdown fence assembly 300 together.

Figure 17:
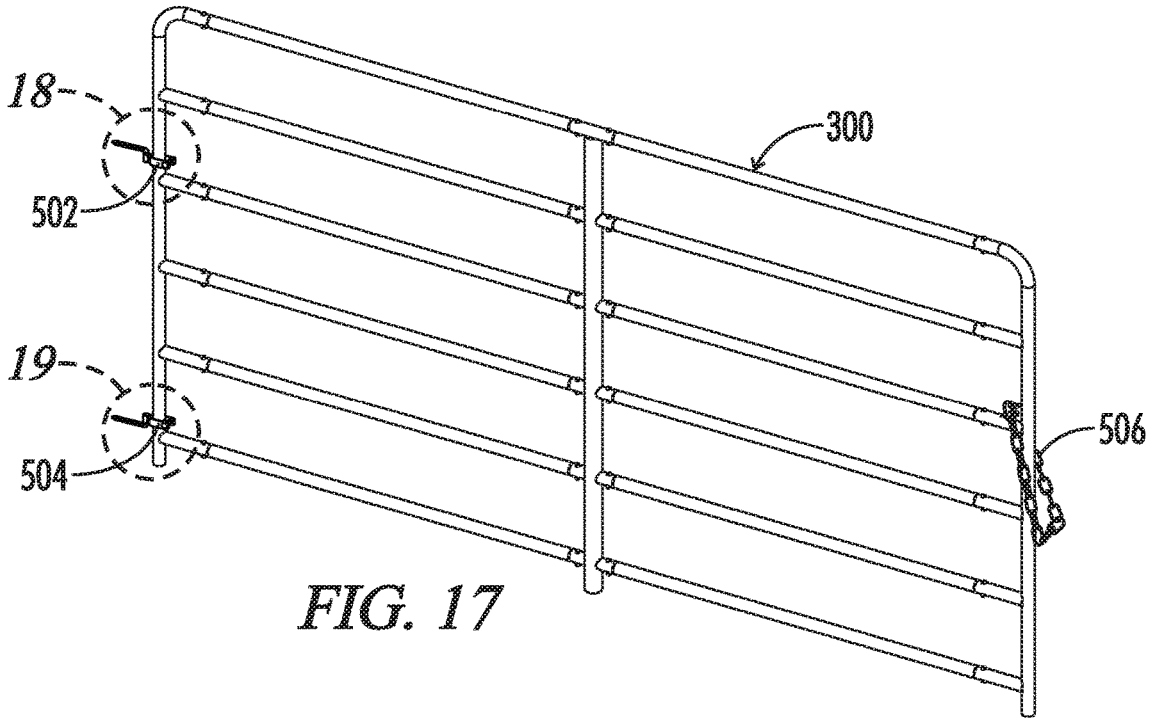
FIG. 17 is an elevation view of the knockdown fence assembly of FIG. 6 with hinges and a latch mechanism attached thereto for mounting of the knockdown fence assembly as a gate.
Figure 18:
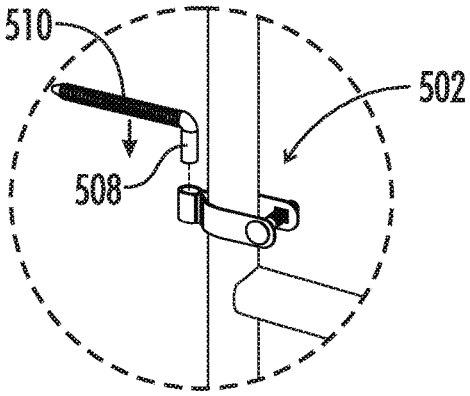
FIG. 18 is an enlarged detail of the upper hinge in the circled area 18 of FIG. 17.
Figure 19:
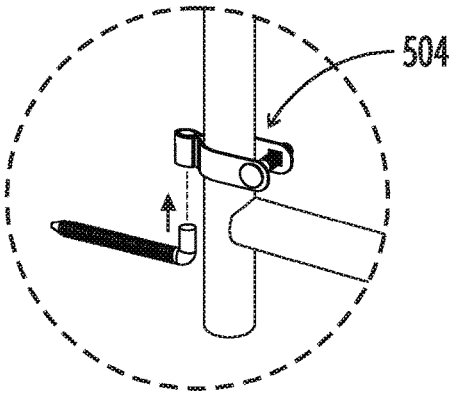
FIG. 19 is an enlarged detail of the lower hinge in the circled area 19 of FIG. 17.
Figure 20:
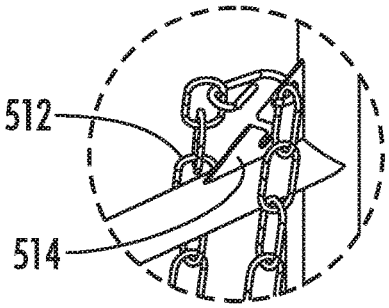
FIG. 20 is an enlarged detail of the latch mechanism of FIG. 17.

When the knockdown fence assembly 300 is used as a gate, it may include hinge brackets coupled to the main body 312, 322 of one of the first end piece 310 or the second end piece 320 and a latch mechanism coupled to the other one of the end pieces 310, 320. FIG. 17 for example shows the knockdown fence assembly 300 of FIG. 6 with hinge brackets 502 and 504, and a latch mechanism 506 attached thereto. Details of the hinge brackets 502 and 504 are shown in FIGS. 18 and 19. Details of the latch mechanism are shown in FIG. 20. The hinge bracket 502 for example includes an L-shaped screw 508 having a threaded end 510 which may be attached to a supporting post (not shown). The latch mechanism 506 for example includes a chain 512 which is connected to a gusset plate 514.

When the knockdown fence assembly 300 is used as a fence, it may include mounting brackets (not shown) coupled to the main bodies 312, 322 of each of the first and second end pieces 310, 320. The mounting brackets may be used to attach the section of fence to a post (not shown) or to an adjacent fence section (not shown).

Referring to FIGS. 11-16, a packaged knockdown fence assembly 400 is provided. The packaged knockdown fence assembly 400 may comprise the respective pieces of either the knockdown fence assembly 100 or the knockdown fence assembly 300. For simplicity, the packaged knockdown fence assembly 400 will be described with reference to the knockdown fence assembly 300, however, it should be noted that the packaged knockdown fence assembly 400 would be the same if described with respect to the knockdown fence assembly 100.

Figure 11:
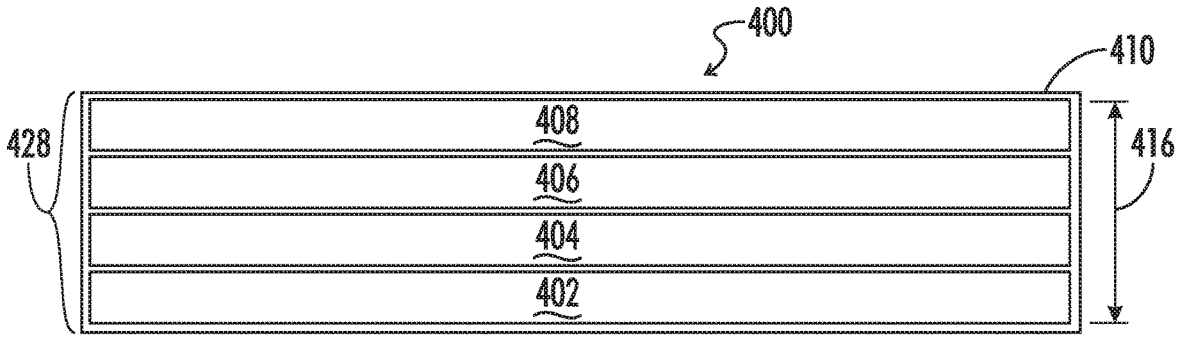
FIG. 11 is a schematic elevation view of a packaged knockdown fence assembly in accordance with the present disclosure.

As can best be seen in FIG. 11, the packaged knockdown fence assembly 400 comprises an end piece layer 402, a first straight connector layer 404, a connector piece layer 406, and a second straight connector layer 408. The first straight connector layer 404 may also be referred to herein as a first straight pipe layer 404. The second straight layer connector 408 may also be referred to herein as a second straight pipe layer 408.

In one embodiment, as can best be seen in FIG. 11, the first straight connector layer 404 may be sandwiched between the end piece layer 402 and the connector piece layer 406. The connector piece layer 406 may be sandwiched between the first straight connector layer 404 and the second straight connector layer 408.

In other embodiments (not shown), the end piece layer 402 and the connector piece layer 406 may be sandwiched in series between the first and second straight connector layers 404, 408. In further embodiments (not shown), the first and second straight connector layers 404, 408 may be sandwiched in series between the end piece layer 402 and the connector piece layer 406. In still further embodiments (not shown), the end piece layer 402 may be sandwiched between the first and second straight connector layers 404, 408 and the second straight connector layer 408 may be sandwiched between the end piece layer 402 and the connector piece layer 406. Various other orderings of the layers are contemplated and included herein without specifically naming the ordering.

Figure 12:
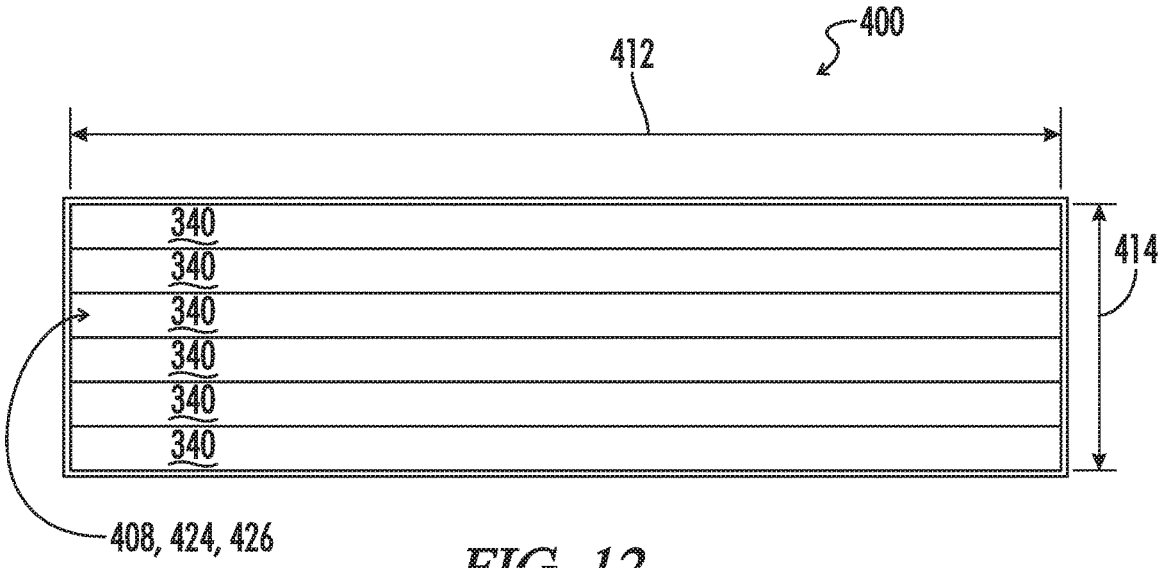
FIG. 12 is a schematic plan view of the packaged knockdown fence assembly of FIG. 11.

As can best be seen in FIGS. 11-12, the packaged knockdown gate assembly 400 further comprises a box 410. The box 410 includes an interior box length 412, an interior box width 414 and an interior box height 416. The interior box length 412 may be greater than or equal to the straight connector length 362 of each of the plurality of straight connectors 340.

Figure 13:
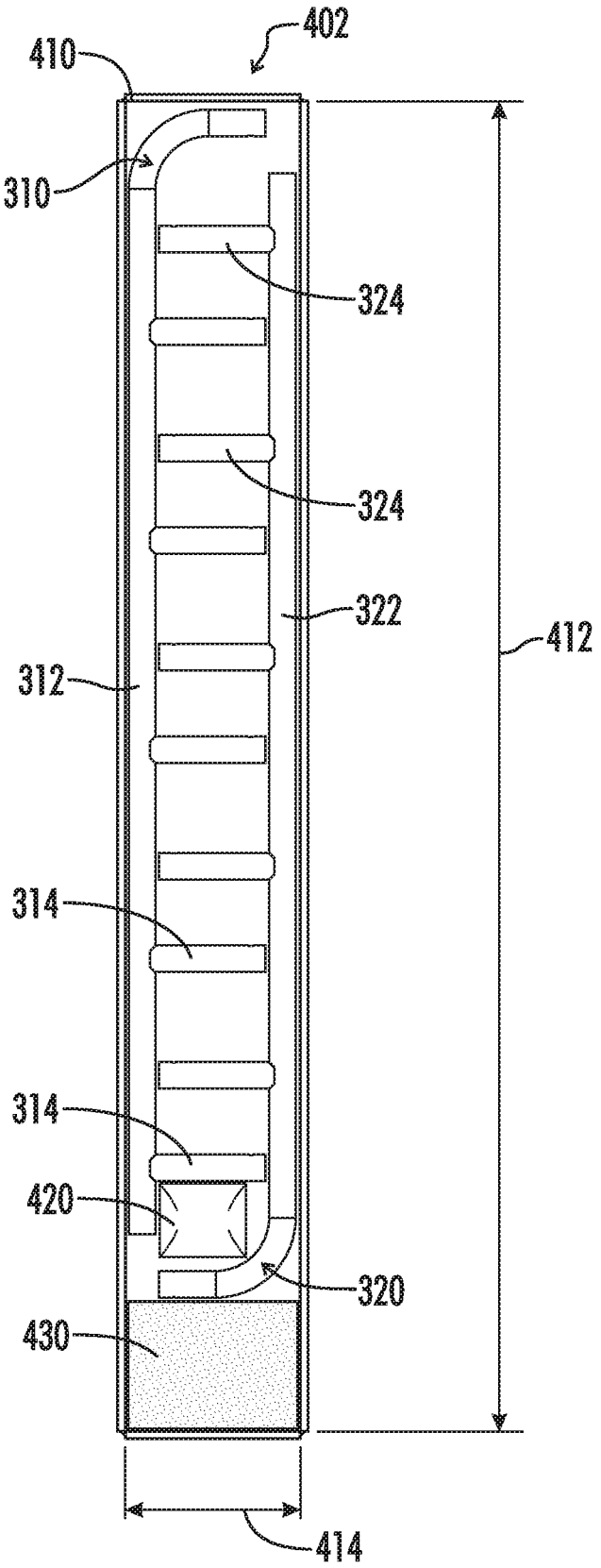
FIG. 13 is a plan view of an end piece layer of the packaged knockdown fence assembly of FIG. 11 in accordance with the present disclosure.

As can best be seen in FIG. 13, the end piece layer 402 includes the first end piece 310 and the second end piece 320. The first and second end pieces 310, 320 may be positioned upside down relative to each other with the pluralities of support pieces 314, 324 extending towards each other. The pluralities of support pieces 314, 324 may be offset from each other and overlapping. In other words, the plurality of support pieces 314 of the first end piece 310 may extend toward and may contact the main body 322 of the second end piece 320. And the plurality of support pieces 324 of the second end piece 320 may extend toward and may contact the main body 312 of the first end piece 310. The end piece layer 402 may further comprise a hardware package 420 positioned between the overlapping pluralities of support pieces 314, 324. The hardware package 420 may include the plurality of fasteners 350 housed therein and may further include assembly instructions (not shown). In other embodiments (not shown), the hardware package 420 may be positioned in the connector piece layer 406.

Figure 14:
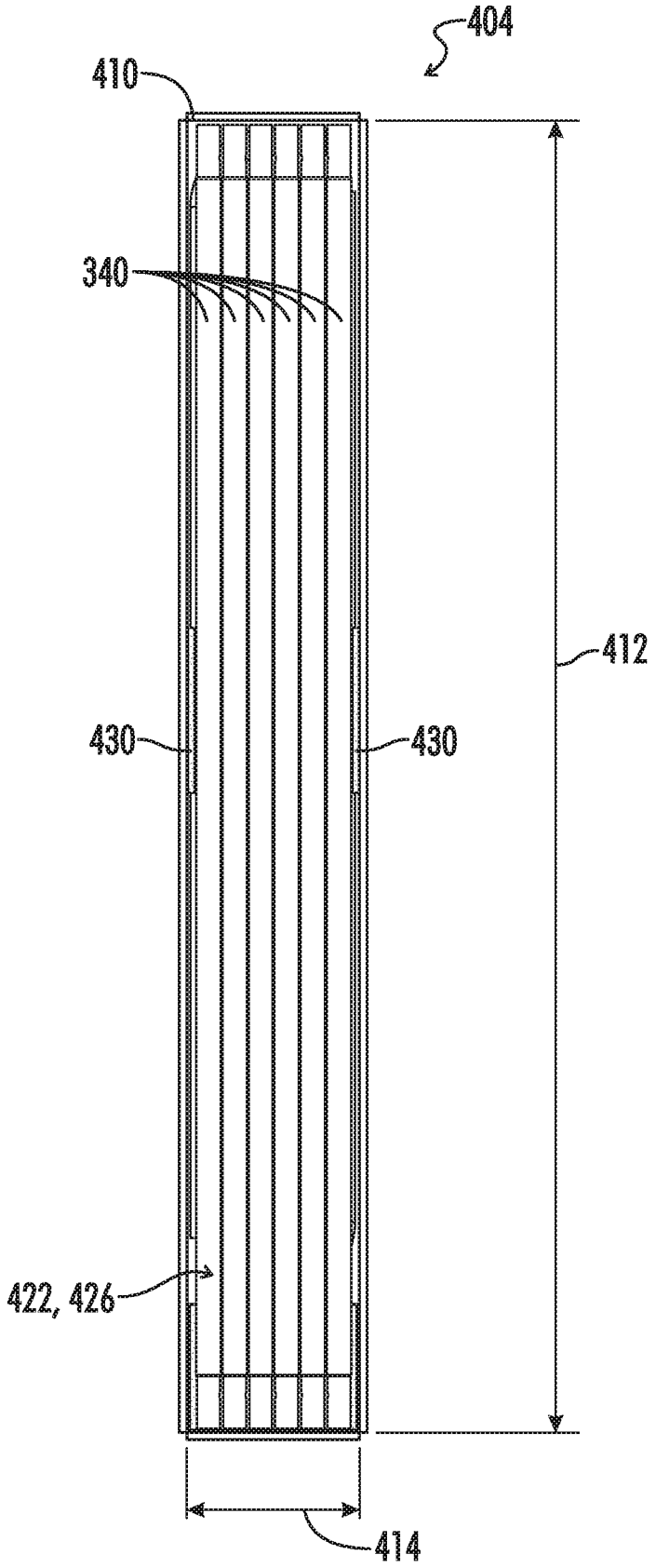
FIG. 14 is a plan view of a first straight connector piece layer of the packaged knockdown fence assembly of FIG. 11 in accordance with the present disclosure.

As can best be seen in FIG. 14, the first straight connector layer 404 includes a first subset 422 of the plurality of straight connectors 340 positioned parallel to each other. As can best be seen in FIG. 12, the second straight connector layer 408 includes a second subset 424 of the plurality of straight connectors 340 positioned parallel to each other. The first straight connector layer 404 may be identical to the second straight connector layer 408, thus additional description regarding the second straight connector layer 408 is unnecessary and/or redundant. Referring back to FIG. 14, pairs of the plurality of straight connectors 340 of the first straight connector layer 404 are bound together, such as for example with plastic zip ties. The first and second subsets 422, 424 of the plurality of straight connectors 340 contain a common number of straight connectors 426. The common number of straight connectors 426 may also be referred to herein as a common number of straight pipes 426.

Figure 15:
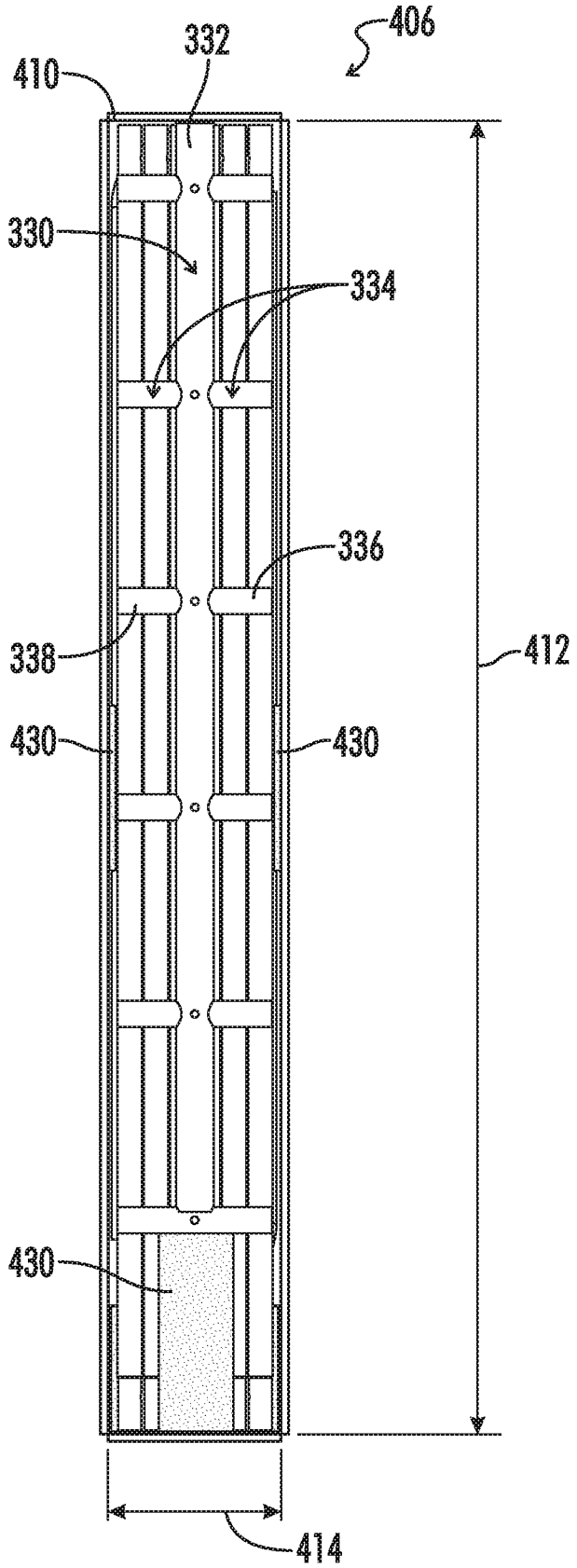
FIG. 15 is a plan view of a connector piece layer of the packaged knockdown fence assembly of FIG. 11 in accordance with the present disclosure.

As can best be seen in FIG. 15, the connector piece layer 406 includes the first connector piece 330. The plurality of pairs of connector support pieces 334 of the first connector pieces 330 are oriented parallel to the interior box width 414. The connector piece width 372 of the first connector piece 330 may be less than or equal to the common number of straight connectors 426 multiplied by the middle portion outer diameter 356 of the plurality of straight connectors 340. This may ensure that a width of the connector piece layer 406 is no greater than a width of either of the first or second straight connector layers 404, 408.

Each of the first and second end pieces 310, 320 includes the end piece width 370. The end piece width 370 may be less than or equal to the common number of straight connectors 426 multiplied by the middle portion outer diameter 356 of the plurality of straight connectors 340. More particularly, the end piece width 370 may be less than or equal to one less than the common number of straight connectors 426 multiplied by the middle portion outer diameter 356 of the plurality of straight connectors 340. This may ensure that a width of the end piece layer 402 is no greater than a width of either of the first or second straight connector layers 404, 408.

Referring back to the box 410, the interior box width may be greater than or equal to the common number of straight connectors 426 multiplied by the middle portion outer diameter 356 of the plurality of straight connectors 340. Furthermore, the interior box height may be greater than or equal to a total number of layers 428 multiplied by the middle portion outer diameter 356 of the plurality of straight connectors 340.

As can best been seen in FIGS. 13-15, the packaged knockdown fence assembly may further include a plurality of packaging spacers 430 positioned along a periphery of an interior of the box or within each layer to ensure that the various layers 402, 404, 406, 408 do not shift and/or get damaged during transport.

Figure 16:
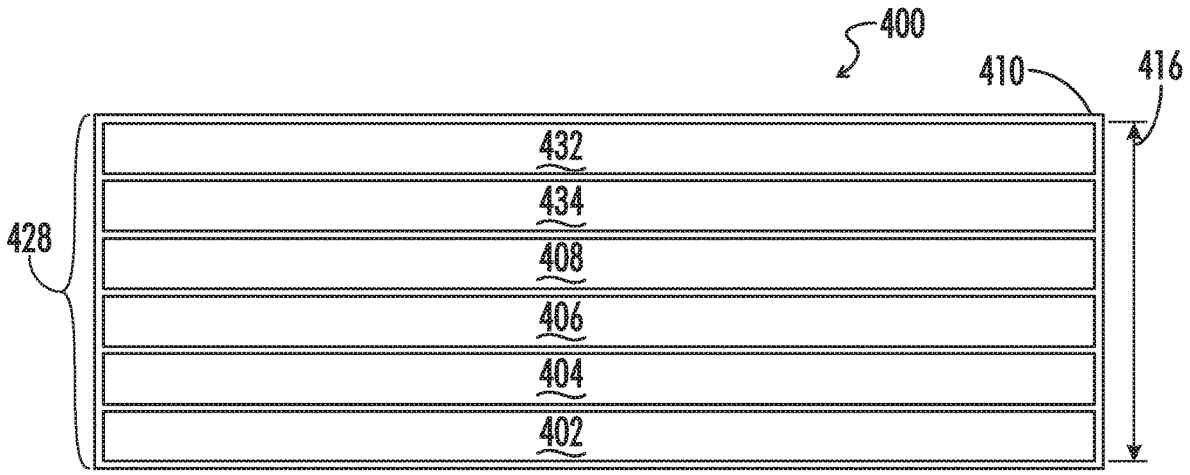
FIG. 16 is a schematic elevation view of an embodiment of the packaged knockdown fence assembly of FIG. 11 including a third straight connector layer and an additional connector piece layer in accordance with the present disclosure.

As can best be seen in FIG. 16, the package knockdown fence assembly 400 may further comprise a third straight connector layer 432 and an additional connector piece layer 434. The third straight connector layer 432 may include a third subset (not shown) of the plurality of straight connectors 340. The third subset may comprise the additional plurality of straight connectors 388. The third straight connector layer 432 may be identical to the first and second straight connector layers 404, 408. The additional connector piece layer 434 includes the second connector piece 390. As illustrated, the additional connector piece layer 434 is sandwiched between the second straight connector layer 408 and the third straight connector layer 432. In other embodiments (not shown), the third straight connector layer 432 and the additional connector piece layer 434 nay be positioned above, below, or intermixed between the various other layers 402, 404, 406, 408 of the packaged knockdown fence assembly 400.

To facilitate the understanding of the embodiments described herein, a number of terms have been defined above. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of new and useful systems, apparatuses, and methods for knockdown livestock fencing, it is not intended that such references be construed as limitations upon the scope of this disclosure except as set forth in the following claims.

What is claimed is:

1. A knockdown fence assembly comprising:

a first end piece including a vertical main body and a plurality of horizontal support pieces extending from the vertical main body in the same direction;

a first connector piece including a vertical main connector body, the first connector piece further including a first plurality of horizontal connector support pieces and a second plurality of horizontal connector support pieces extending from the vertical main connector body in opposite directions;

a first plurality of horizontal connectors coupled between the plurality of horizontal support pieces of the first end piece and the first plurality of horizontal connector support pieces of the first connector piece, the first plurality of horizontal connectors extending into the vertical main connector body of the first connector piece;

a second plurality of horizontal connectors extending into the vertical main connector body of the first connector piece and overlapping with respective horizontal connectors of the first plurality of horizontal connectors to define overlapping end portions of the first and second pluralities of horizontal connectors; and a plurality of connector fasteners, each connector fastener extending through the vertical main connector body and respective overlapping end portions of the first plurality of horizontal connectors and the second plurality of horizontal connectors.

2. The knockdown fence assembly of claim 1, further comprising:

a second end piece including a vertical main body and a plurality of horizontal support pieces extending from the vertical main body in the same direction, the second plurality of horizontal connectors coupled between the plurality of horizontal support pieces of the second end piece and the second plurality of horizontal connector support pieces of the first connector piece.

3. The knockdown fence assembly of claim 1, further comprising:

a second end piece including a vertical main body and a plurality of horizontal support pieces extending from the vertical main body in the same direction;

a second connector piece including a vertical main connector body, the second connector piece further including a first plurality of horizontal connector support pieces and a second plurality of horizontal connector support pieces extending from the vertical main connector body in opposite directions, the second plurality of horizontal connectors coupled between the second plurality of horizontal connector support pieces of the first connector piece and the first plurality of horizontal connector support pieces of the second connector piece, the second plurality of horizontal connectors extending into the vertical main connector body of the second connector piece; and a third plurality of horizontal connectors coupled between the plurality of horizontal support pieces of the second end piece and the second plurality of horizontal connector support pieces of the second connector piece, the third plurality of horizontal connectors extending into the vertical main connector body of the second connector piece and overlapping with respective horizontal connectors of the second plurality of horizontal connectors to define overlapping end portions of the second and third pluralities of horizontal connectors.

4. The knockdown fence assembly of claim 1, wherein:

the overlapping end portions of the first and second pluralities of horizontal connectors include matching beveled cuts.

5. The knockdown fence assembly of claim 4, wherein:

the beveled cuts of the overlapping end portions are angled less than or equal to 60 degrees relative to a length of the horizontal connector.

6. The knockdown fence assembly of claim 1, wherein:

the overlapping end portions of the first and second pluralities of horizontal connectors include matching semi-cylindrical cuts.

7. The knockdown fence assembly of claim 6, wherein:

the matching semi-cylindrical cuts include a length at least as long as a diameter of the matching semi-cylindrical cuts.

8. The knockdown fence assembly of claim 1, wherein:

each connector of the first and second pluralities of horizontal connectors includes one of the overlapping end portions;

each overlapping end portion of the first plurality of horizontal connectors includes a first diameter;

each overlapping end portion of the second plurality of horizontal connectors includes a second diameter smaller than the first diameter; and the overlapping end portions of the first plurality of horizontal connectors concentrically receive the overlapping end portions of the second plurality of horizontal connectors.

9. The knockdown fence assembly of claim 8, wherein:

the overlapping end portions of the first and second pluralities of horizontal connectors include a length greater than or equal to a diameter of the first and second pluralities of horizontal connector support pieces.

10. The knockdown fence assembly of claim 1, wherein:

the vertical main connector body includes a vertical main connector body diameter;

each of the first plurality of horizontal connector support pieces and the second plurality of horizontal connector support pieces includes a connector support diameter smaller than the vertical main connector body diameter.

11. The knockdown fence assembly of claim 10, wherein:

the first plurality of horizontal connector support pieces and the second plurality of horizontal connector support pieces define a plurality of pairs of horizontal connector support pieces; and each pair of horizontal connector support pieces is formed by a continuous pipe extending through the vertical main connector body.

12. The knockdown fence assembly of claim 1, wherein:

each of the first plurality of horizontal connectors includes a first reduced diameter end portion including the overlapping end portion;

each of the second plurality of horizontal connectors includes a first reduced diameter end portion including the overlapping end portion;

a connector piece width is defined between free ends of the first and second pluralities of horizontal connector support pieces; and a reduced diameter end portion length of the first reduced diameter end portion of each of the first and second pluralities of horizontal connectors is substantially equal to a summation of one-half of the connector piece width and one-half of a length of the overlapping end portions.

13. The knockdown fence assembly of claim 12, wherein:

each of the first plurality of horizontal connectors includes a second reduced diameter end portion opposite the first reduced diameter end portion, the second reduced diameter end portion of each of the first plurality of horizontal connectors is received in one of the plurality of horizontal support pieces of the first end piece; and each of the second plurality of horizontal connectors includes a second reduced diameter end portion opposite the first reduced diameter end portion.

14. The knockdown fence assembly of claim 1, further comprising:

a plurality of first end fasteners, each first end fastener extending through one of the plurality of horizontal support pieces of the first end piece and one of the first plurality of horizontal connectors.

15. The knockdown fence assembly of claim 14, wherein:

the plurality of first end fasteners are oriented parallel to the vertical main body of the first end piece; and the plurality of connector fasteners are oriented perpendicularly to the vertical main connector body of the first connector piece and perpendicularly to the first and second pluralities of horizontal connector support pieces.

16. A method of assembling a knockdown fence comprising:

providing a first connector piece including a main connector body extending in a first direction and a plurality of pairs of connector support pieces extending from the main connector body in opposite directions parallel to a second direction, the second direction being perpendicular to the first direction, each pair of connector support pieces including a left connector support piece and a right connector support piece;

receiving a first left pipe into the left connector support piece of a first one of the pairs of connector support pieces, the first left pipe extending into the main connector body;

receiving a first right pipe into the right connector support piece of the first one of the pairs of connector support pieces, the first right pipe extending into the main connector body and overlapping with the first left pipe; and inserting a fastener through the main connector body in a third direction to bind the first left pipe and the first right pipe to the main connector body, the third direction being perpendicular to both the first direction and the second direction.

17. The method of claim 16, further comprising:

receiving a second left pipe into the left connector support piece of a second one of the pairs of connector support pieces, the second left pipe extending into the main connector body;

receiving a second right pipe into the right connector support piece of the second one of the pairs of connector support pieces, the second right pipe extending into the main connector body and overlapping with the second left pipe; and inserting another fastener through the main connector body in the third direction to bind the second left pipe and second right pipe to the main connector body.

18. The method of claim 16, further comprising:

providing a first end piece having a main body extending in the first direction and a plurality of support pieces extending perpendicularly from the main body toward the left connector support pieces;

receiving the first left pipe into one of the plurality of support pieces of the first end piece;

providing a second end piece having a main body extending in the first direction and a plurality of support pieces extending perpendicularly from the main body toward the right connector support pieces; and receiving the first right pipe into one of the plurality of support pieces of the second end piece.

19. The method of claim 16, further comprising:

providing a second connector piece including a main connector body extending in the first direction and a plurality of pairs of connector support pieces extending from the main connector body in opposite directions parallel to the second direction, each pair of connector support pieces including a left connector support piece and a right connector support piece;

receiving the first right pipe into the left connector support piece of a first one of the pairs of connector support pieces of the second connector piece, the first right pipe extending into the main connector body of the second connector piece; and receiving a first additional pipe into the right connector support piece of the first one of the pairs of connector support pieces of the second connector piece, the first additional pipe extending into the main connector body of the second connector piece and overlapping with the first right pipe.

20. The method of claim 19, further comprising:

providing a first end piece having a main body extending in the first direction and a plurality of support pieces extending perpendicularly from the main body toward the left connector support pieces of the first connector piece;

receiving the first left pipe into one of the plurality of support pieces of the first end piece;

providing a second end piece having a main body extending in the first direction and a plurality of support pieces extending perpendicularly from the main body toward the right connector support pieces of the second connector piece; and receiving the first additional pipe into one of the plurality of support pieces of the second end piece.

* * * * *